US006189357B1

(12) United States Patent
Baumgarten et al.

(10) Patent No.: US 6,189,357 B1
(45) Date of Patent: Feb. 20, 2001

(54) APPARATUS AND PROCESS FOR FORMING VEHICLE WHEEL RIMS

(75) Inventors: John M. Baumgarten, Novi; Romulo A. Prieto, Northville, both of MI (US)

(73) Assignee: Hayes Lemmerz International, Inc., Northville, MI (US)

( * ) Notice: Under 35 U.S.C. 154(b), the term of this patent shall be extended for 0 days.

(21) Appl. No.: 08/960,008

(22) Filed: Oct. 29, 1997

Related U.S. Application Data

(60) Provisional application No. 60/029,330, filed on Oct. 29, 1996.

(51) Int. Cl.[7] ..... B21D 22/16
(52) U.S. Cl. ..... 72/70
(58) Field of Search ..... 72/70, 71, 72; 29/894.35, 894.353, 894.354

(56) References Cited

U.S. PATENT DOCUMENTS 1,478,060 * 12/1923 Richman ..... 72/70
4,185,370 1/1980 Evans .
4,554,810 11/1985 Jurus .
4,962,587 10/1990 Ashley, Jr. et al. .
5,027,508 * 7/1991 Cissell, II ..... 29/894.354
5,548,896 8/1996 Archibald et al. .

FOREIGN PATENT DOCUMENTS 4-55031 * 2/1992 (JP) ..... 29/894.354

* cited by examiner

*Primary Examiner*—Lowell A. Larson
(74) *Attorney, Agent, or Firm*—MacMillan, Sobanski & Todd, LLC

(57) ABSTRACT

An apparatus for spin forming two partial wheel rims including a mandrel having a first portion for spin forming a first partial wheel rim and second portion for spin forming a second partial wheel rim. The first and second portions of the mandrel have different shapes such that the first and second wheel rims have different shapes. The mandrel is mounted upon a spin forming machine and is utilized to spin form a hoop of metal into a double wheel rim which is split to form the two partial wheel rims.

16 Claims, 6 Drawing Sheets

APPARATUS AND PROCESS FOR FORMING VEHICLE WHEEL RIMS

CROSS REFERENCE TO RELATED APPLICATION

This application claims the benefit of U.S. Provisional Application No. 60/029,330, which was filed on Oct. 29, 1996.

BACKGROUND OF THE INVENTION

This invention relates in general to vehicle wheels and in particular to an apparatus and a process for simultaneously spin forming a pair of partial wheel rims.

It is known in the art to fabricate a two piece vehicle wheel by attaching a wheel disc to a separately formed wheel rim. Typically, the wheel disc is cast or forged while the wheel rim is rolled or spun from strip stock. Such two piece wheels are less expensive to manufacture than a cast one piece wheel while permitting use of stylistic designs for the wheel disc. Both the wheel disc and wheel rim can be formed from alloys of the same light weight metal, such as aluminum, magnesium or titanium, or, as a further cost reduction, a wheel disc formed from an alloy of a light weight metal can be attached to a rim rolled from steel. When different metals are used to form the wheel disc and wheel rim, the assembled wheel is commonly called a bimetal wheel.

To further improve the appearance of the wheel, the wheel disc can be formed to include the outboard tire retaining bead. The resulting wheel disc, which is usually called a full face wheel disc, is attached to the outboard end of a partial wheel rim. The attachment can occur at the outboard tire bead seat, the dropwell, or another location. The assembled wheel is often referred to as a full face wheel. When a tire is mounted upon a full face wheel, the joint between the wheel disc and wheel rim is completely hidden and only the wheel disc is visible. A decorative finish is often applied to the face of the wheel disc to further enhance the appearance of the wheel. Examples of typical decorative finishes include metal plating, such as chromium plating, clear coatings and paint.

As described above, the partial wheel rims used to form full face wheels can be spun from a hoop of metal. The spinning process begins by placing the hoop upon a mandrel having the desired shape of the wheel rim. The mandrel is mounted upon a conventional spin forming machine which rotates the mandrel and hoop while rollers are pressed against and traversed axially across the outer surface of the hoop to form a wheel rim. The rollers axially stretch and radially thin the hoop while forcing the hoop to conform to the shape of the mandrel. Usually several axial passes of the roller are required to form the wheel rim. Additionally, a plurality of rollers may be sequentially applied to the hoop to form specific portions of the wheel rim.

Increasingly, vehicle manufactures are requiring wheels designed for specific vehicles. Such wheels can require different wheel rim shapes to accommodate tires designed for the vehicle. Accordingly, in order to efficiently utilize the spin forming machinery, it is often necessary to change the mandrel on a spin forming machine to spin a differently shaped wheel rim.

Referring now to the drawings, there is shown in FIG. 1 a time line for a typical operations sequence for a spin forming machine being utilized to spin two differently shaped wheel rims which is in accordance with the prior art.

For illustrative purposes, the wheel rims are designated rim "A", which is spun upon a mandrel A, and rim "B", which is spun upon a mandrel B. Before $t_1$, mandrel A is mounted upon the spinning machine.

At $t_1$, a first production run begins with wheel rim A being spun on mandrel A. The first production run continues until $t_2$, at which time the spin forming machine is stopped. Mandrel A is removed from the spin forming machine and mandrel B is mounted thereon. The time period from $t_2$ to $t_3$ is referred to "changeover", or "down", time and, because the spin forming machine is not operating, represents a period of non-production of wheel rims. At $t_3$, a second production run begins with wheel Rim B being formed upon the spin forming machine. The second production run continues until $t_4$, when the spin forming machine is again stopped for another changeover period to reinstall mandrel A. The process described above is repeated, beginning at $t_5$. Accordingly, one complete cycle for the spin forming machine, which extends from $t_1$ through $t_5$, includes two production runs and two changeover periods.

SUMMARY OF THE INVENTION

This invention relates to an apparatus and a process for simultaneously spin forming a pair of partial wheel rims.

As described above, a typical process for spin forming different wheel rims on a single spin forming machine requires periodic changeover time periods during which production is halted while the mandrel is changed. These changeover time periods can represent a significant loss of production for the spin forming machine. For example, assume that the production run time periods shown in FIG. 1, which are from $t_1$ to $t_2$ and from $t_3$ to $t_4$, last 20 hours each. Also, assume that each of the change over periods lasts ten hours. Accordingly, for the example, during a 60 hour period, wheel rims are being produced for only 40 hours while the spin forming machine is down for 20 hours to change mandrels. Thus, 33 percent of potential production is lost for the spin forming machine because of changeovers. Additionally, the wheel rims formed immediately following a changeover are often defective. Accordingly, additional production time can be lost, Furthermore, the physical act of changing the mandrel can result in damage to the spin forming machine and/or mandrel.

The wheel rim inventory resulting from the above described production process is illustrated in FIG. 2, where the shaded areas represent changeover periods. As shown in FIG. 2, during the first production run, from $t_1$ to $t_2$, wheel rim A is produced at a greater rate than the rims are being attached to wheel discs to form assembled two piece wheels. Accordingly, the inventory of wheel rim A, which is shown by a solid line in FIG. 2, increases to a maximum at $t_2$. Then during the two changeover time periods and the wheel rim B production run, the inventory of wheel rim A is reduced as completed wheels with wheel rim A continue to be produced. While FIG. 2 shows the inventory of wheel rim A reaching zero at $t_5$ when production of wheel rim A resumes, it will be appreciated that some minimum inventory would be maintained. Similarly, the inventory of wheel rim B, which is shown by a dashed line in FIG. 2, also fluctuates. Because of the changes in wheel rim inventory, additional warehouse space is required to store the inventory for each of wheel rims during the production runs of the other wheel rim.

Accordingly, a more efficient spinning apparatus and manufacturing process which would increase spin forming machine productivity while levelizing wheel rim inventory would be desirable.

The present invention is directed toward a mandrel for a spin forming vehicle wheels. The mandrel includes a first portion having a first shape, the first portion being adapted for spin forming a first vehicle wheel rim. The mandrel also includes a second portion having a second shape, the second portion being adapted for spin forming a second vehicle wheel rim. In the preferred embodiment, the second shape is different from the first shape, whereby the second vehicle wheel rim formed on the second mandrel portion has a different shape from the first vehicle wheel rim formed on the first mandrel portion. However, the invention also contemplates that the second portion of the mandrel can be symmetrical to the first portion of the mandrel. In such a case, two identical wheel rims can be spun upon the mandrel. Additionally, the first and second portions of the mandrel can have different widths and/or different diameters such that wheel rims spun upon the mandrel are formed having different widths and/or diameters, respectively.

The present invention also is directed toward an apparatus which includes a spin forming machine having the mandrel mounted thereon. The apparatus also includes at least one forming roller adapted to spin form a hoop of metal over the mandrel to form a double wheel rim having a first portion shaped to conform to the first portion of the mandrel and a second portion shaped to conform to the second portion of the mandrel. The apparatus can further include a cutting roller adapted to split the double wheel rim into first and second wheel rims with the first wheel rim corresponding to the first portion of the double wheel rim and the second wheel rim corresponding to the second portion of the double wheel rim. Accordingly, the second wheel rim has a different shape from the first wheel rim. In the preferred embodiment, the first and second wheel rims are partial wheel rims.

The present invention also contemplates a process for fabricating a wheel rim comprising providing a spin forming machine, the machine including a mandrel having a first portion having a first shape and a second portion having a second shape. A metal hoop is spun upon the mandrel to form a double wheel rim having a tire retraining flange formed upon each end thereof. The double wheel rim is then split along a plane perpendicular to the rim axis to form a first wheel rim and a second wheel rim. The first wheel rim has a first shape corresponding to the shape of the first portion of the mandrel and the second wheel rim has a second shape corresponding to the shape of the second portion of the mandrel.

In the preferred embodiment, the first shape of the first portion of the mandrel is different from the second shape of the second portion of the mandrel. Accordingly, the second wheel rim shape is different form the first wheel rim shape. Furthermore, in the preferred embodiment, the wheel rims formed on the mandrel are partial wheel rims. Subsequent to spin forming the wheel rims, each of the partial wheel rims is attached to a fall face wheel disc to form a pair of vehicle wheels.

Additionally, the first portion of the mandrel can have a first width and the second portion of the mandrel can have a second width which is different from the first width. Accordingly, the first wheel rim formed on the first portion of the mandrel will have a width which is different from the width of the second wheel rim formed upon the second portion of the mandrel.

Alternately, the second portion of the mandrel is symmetrical to the first portion of the mandrel and the first wheel rim is identical to the second wheel rim.

The invention also contemplates that the first portion of the mandrel can have a first diameter and the second portion of the mandrel can have a second diameter which is different from the first diameter such that the first wheel rim formed on the first portion of the mandrel will have a diameter which is different from the diameter of the second wheel rim formed upon the second portion of the mandrel.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 3:
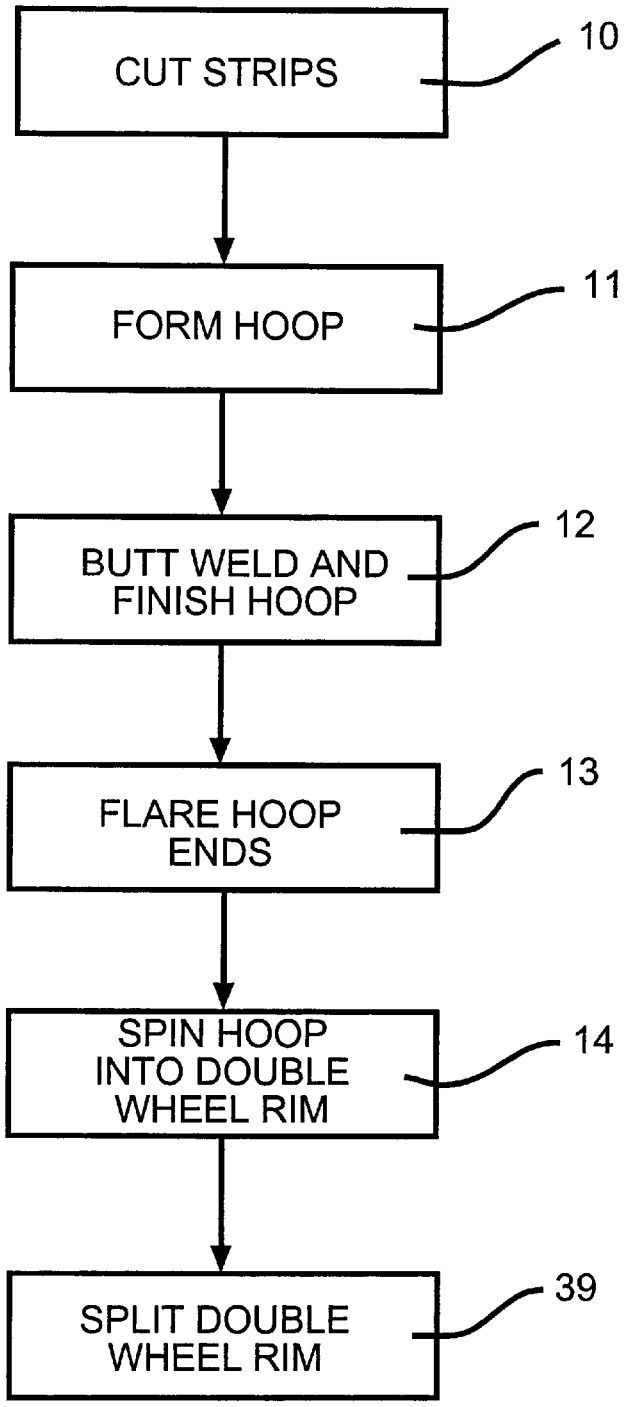
FIG. 3 is a flow chart for a process for spin forming wheel rims in accordance with the invention.

Referring again to the drawings, there is illustrated in FIG. 3, a flow chart for spinning wheel rims in accordance with the invention. In functional block 10, a flat sheet of metal is cut into a plurality of strips (not shown). The sheet can be formed from a ferrous alloy or a light weight metal, such as an alloy of aluminum, titanium or magnesium. In the preferred embodiment, an aluminum alloy which does not require heat treatment, such as 5454, is used to form the hoop. The subsequent working of the hoop will harden the metal, thereby eliminating the need to heat treat the resulting wheel rim. Alternately, the strips can be precut before shipping to the manufacturing facility.

In functional block 11, each of the strips are formed into a circular hoop (not shown). The ends of the hoop are joined by a conventional process, such as butt welding, in functional block 12. The edges of the hoop are finished by a conventional process, such as burr cutting and/or edge nipping. The ends of the hoop are then flared in an outward radial direction in functional block 13.

Figure 1:
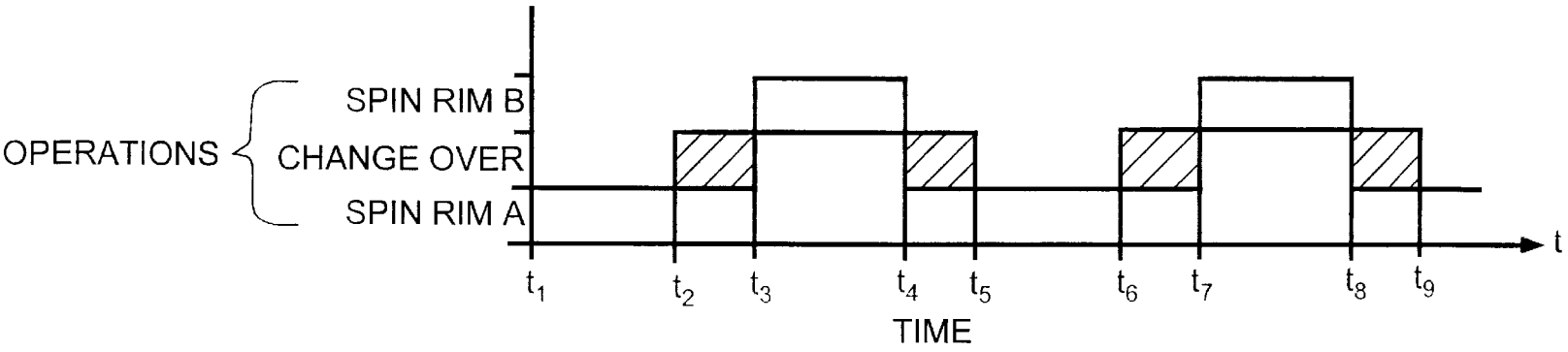
FIG.1 (PRIOR ART)
FIG. 1 is a time line for a wheel rim manufacturing process in accordance with the prior art.
Figure 2:
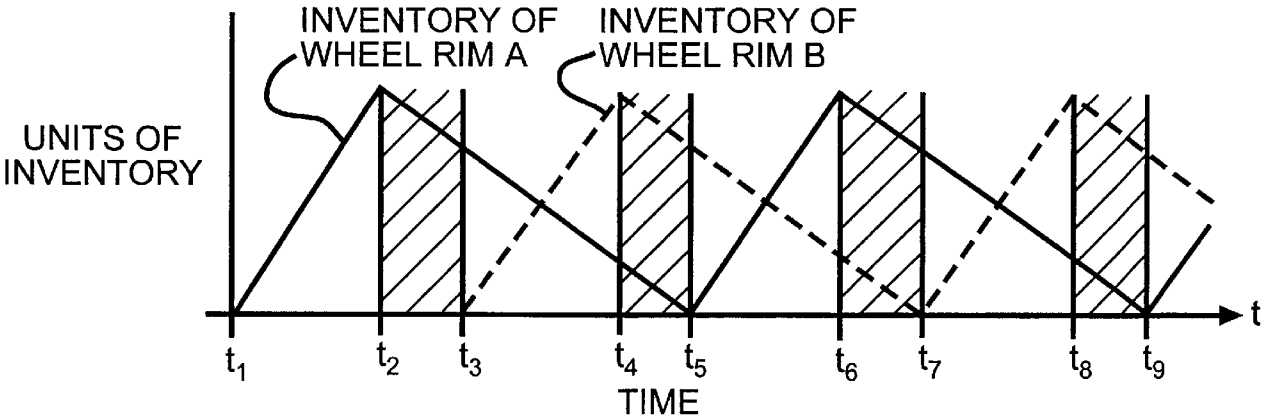
FIG. 2 (PRIOR ART)
FIG. 2 is a time line which illustrates the inventory of wheel rims produced by the process shown in FIG. 1.
Figure 4:
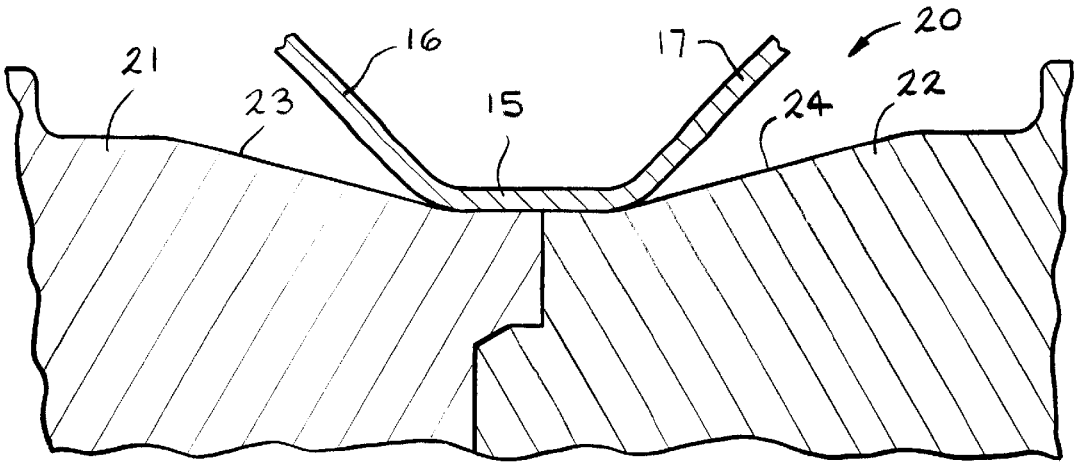
FIG. 4 is a fragmentary sectional view of a spinning apparatus used in the process shown in FIG. 3

In functional block 14, the flared hoop is mounted upon a conventional spin forming machine for shaping into a double wheel rim which will be split into two partial wheel rims. In FIG. 4, a hoop 15 having flared ends 16 and 17 is shown mounted upon a rotatable multi-piece mandrel 20 of a spin forming machine (not shown). For simplicity, only a portion of the mandrel 20 is shown in FIG. 2. The mandrel 20 extends into the wheel hoop 15 and includes a first portion 21 and a second portion 22 which are axially movable for release of the finished wheel rims. The mandrel portions 21 and 22 have outer surfaces 23 and 24, respectively, which are shaped to correspond to the desired shape of the interior surface of the wheel rims. The first portion 21 has a linearly tapered outer surface 23 for forming a straight rim while the second portion 22 has a curved surface 24 for forming a bell shaped rim. While two portions 21 and 22 of the mandrel are shown, it will be appreciated that the mandrel 20 can include a plurality of components and that the shape of the wheel rims can be altered by replacing some or all of the mandrel components.

Figure 5:
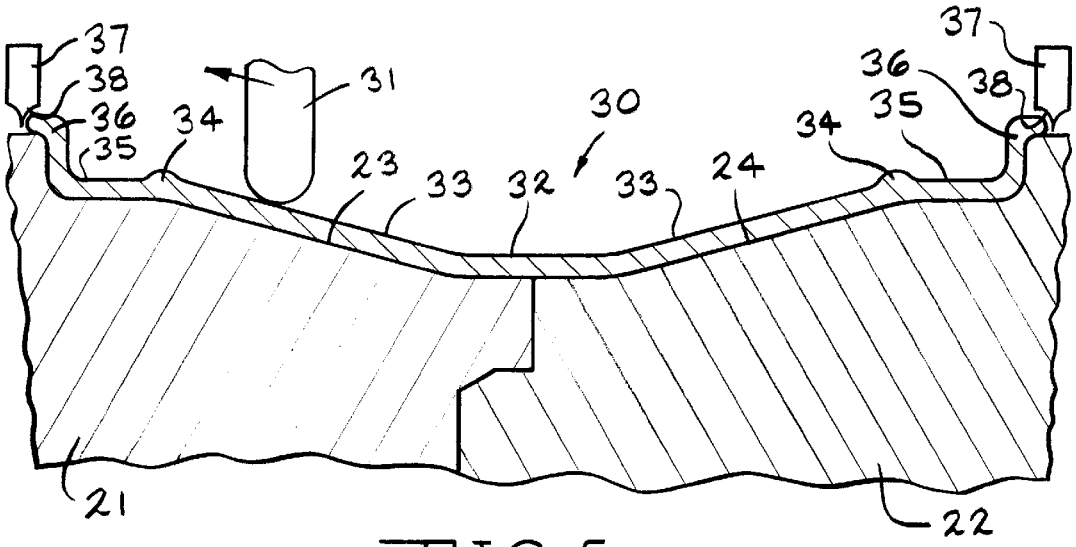
FIG. 5 is a fragmentary sectional view illustrating the spinning process shown in FIG. 3
Figure 6:
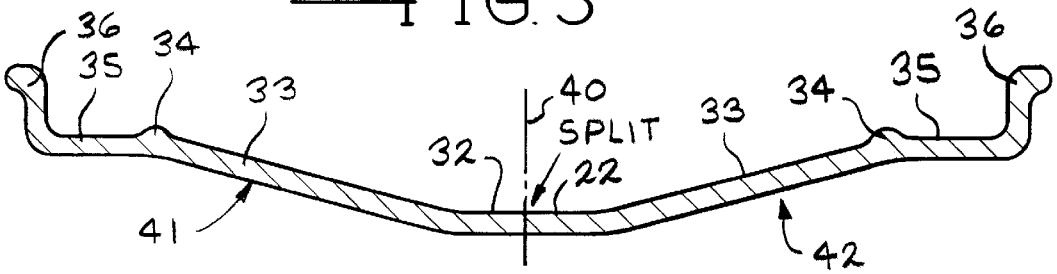
FIG. 6 is a fragmentary sectional view illustrating splitting of the wheel form formed in the process shown in FIG. 3

The hoop 15 and mandrel 20 are spun by the spin forming machine in functional block 25 to form a double wheel rim 30, as illustrated in FIG. 5. A spinning or forming roller 31 is supported upon a mounting mechanism (not shown) for rotation about an axis which is parallel to the axis of the mandrel 20. The position of the roller mounting mechanism relative to the mandrel 20 is controlled by a conventional, two axis, indexing device. During the spinning operation, the forming roller 31 is pressed radially against and moved axially along the outer surface of the hoop 15 by the indexing device, as shown by the small directional arrow in FIG. 5. The forming roller 31 cooperates with the mandrel 20 to thin and axially stretch the hoop 15 into the double wheel rim 30. As the roller 31 presses against the hoop 15, the double wheel rim 30 is shaped to correspond to the outer surfaces 23 and 24 of the mandrel portions 21 and 22. Additionally, the cold working of the hoop metal by the roller 31 hardens the metal and restores any mechanical characteristics which may have been lost during the butt welding process. The thickness of the double wheel rim 30 can be controlled to provide either a uniform thickness or a varying thickness, as described in U.S. Pat. No. 4,962,587, which is incorporated herein by reference.

Generally, the spinning operation proceeds to the left and right from the center of the hoop 15 in FIG. 3 and can involve multiple passes of the forming roller 31. The double wheel rim 30 is formed to include a portion of a deep well 32 which extends axially outward from the center thereof. Leg portions 33 are formed adjacent to the deep well portion 32. Inboard tire safety beads 34 and bead seats 35 are formed at the outer ends of the leg portions 33. The outer ends of the double wheel rim 30 are worked against the mandrel portions 21 and 22 to form inboard tire retaining flanges 36.

It will appreciated that a plurality of forming rollers can be used to shape the double wheel rim 30. For example, a bead roller (not shown) having a center circumferential groove could be used to compress the double wheel rim 30 to form the tire safety beads 34. Similarly, a cone shaped roller (not shown) could be used to form the inboard tire retaining flanges 36. All the forming rollers would be mounted upon the spin forming machine and sequentially applied to the double wheel rim 30.

The ends of the double wheel rim 30 are trimmed by a pair of pinch trim rollers 37 which are pressed against the outer ends of the inboard tire retaining flanges 36. The trimming rollers 37 have an outer edge 38 which is formed to produce a specific shape, such as, for example, a MC, T, AW, P or C type flange, on the end of the tire retaining flanges 36. Because the spinning and trimming operations are completed on one machine, it is not necessary to remount the wheel on a separate trimming machine. Thus, the time needed to manufacture a wheel is reduced.

In functional block 39, the double wheel rim 30 is split along a cutting plane 40 which is perpendicular to the wheel rim axis to form two partial wheel rims 41 and 42, which are shown in FIG. 4. The splitting can be done with another roller (not shown) while the double wheel rim 30 is mounted upon the spinning mandrel 20. Alternately, the double wheel rim 30 can be removed from the spinning apparatus and split on a separate machine (not shown).

A full face wheel disc (not shown) is attached to the outboard end of each partial wheel rim by a conventional process, such as, for example, electron beam, friction, arc or inertial welding, to form a vehicle wheel. In the preferred embodiment, an air-tight continuous circumferential weld (not shown) is formed between the wheel disc and the outboard end of the wheel rim to prevent air loss when a pneumatic tire is mounted upon the wheel.

Figure 7:
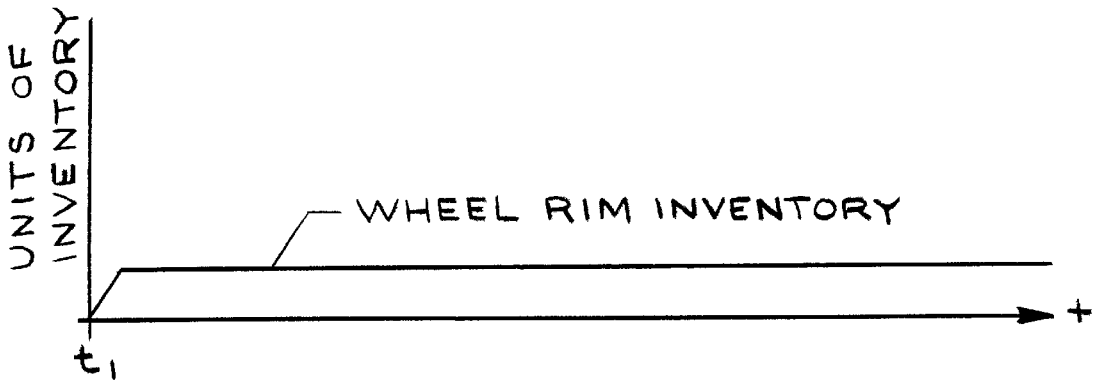
FIG. 7 is a time line which illustrates the inventory of wheel rims produced by the process shown in FIG. 3.

The process described above provides a useful improvement in the manufacture of wheel rims by eliminating the need to reconfigure the spin forming machine with a different mandrel to form a different wheel rim. Instead, a spin forming machine having a mandrel as described above for spinning two different wheel rims and operated in accordance with the invention can continuously produce two distinct types of partial wheel rims. Thus, machine productivity is increased by eliminating change over periods. Additionally, as shown in FIG. 7, wheel rim inventory can be levelized at a smaller value. The horizontal line in FIG. 7 represents the inventory for both type A and B rims produced by a single spin forming machine and the process in accordance with the invention.

As can be clearly seen from FIG. 7, the size of the inventory is substantially reduced, thus reducing warehousing costs. Hence, the process for forming two different wheel rims on a single spin forming machine not only increases productivity for the machine, but also provides a solution to a different problem, namely, production of an excessive wheel rim inventory. Indeed, since the wheel rims are continually produced, it is also contemplated that the spin forming machine could be co-located at the wheel disc manufacturing facility. This would allow attachment of the wheel rims to the wheel discs as they are produced. By matching the rim production rate to the disc production rate, the need to store an inventory of wheel rims can be eliminated. If the number of one type of rim begins to increase over the number of the other type of rim, a spinner and mandrel can be used to reshape the extra rims to balance the inventory of rims.

Additionally, because one spin forming machine can form two rims, the number of spin forming machines can be reduced by half, reducing capital investment in spin forming machines by 50 percent. Elimination of change over periods also eliminates the scrap which can occur during the start up of a production run following change over. For low volume production runs, the scrap rate can be rather high.

Furthermore, the spinning process provides a more uniform wheel rim than other conventional manufacturing processes. Accordingly, less material is needed on the bead seat area for machining, which provides better control of diameter and runout. Also, spinning allows significant changes in the wheel rim shape by substituting mandrels without tool changes. Thus, the present invention provides solutions to a number of problems and significant improvements in the manufacturing process for wheel rims.

Figure 8:
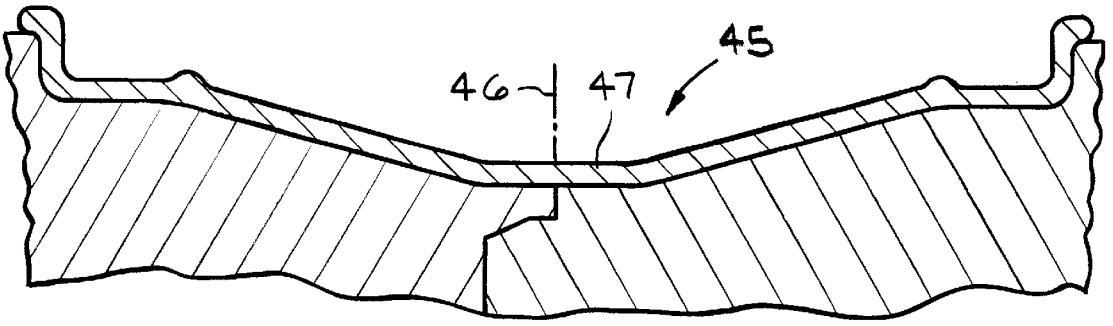
FIG. 8 is a fragmentary sectional view of an alternate embodiment of the spinning apparatus shown in FIG. 4.

The present invention also contemplates spinning a double wheel rim 45 upon a mandrel which is symmetrical about a cutting plane 46, as shown in FIG. 8. The cutting plane 46 passes through the center of a deep well portion 47 of the double wheel rim 45. Accordingly, two identical partial wheel rims are formed when the double wheel rim 45 is split.

Figure 9:
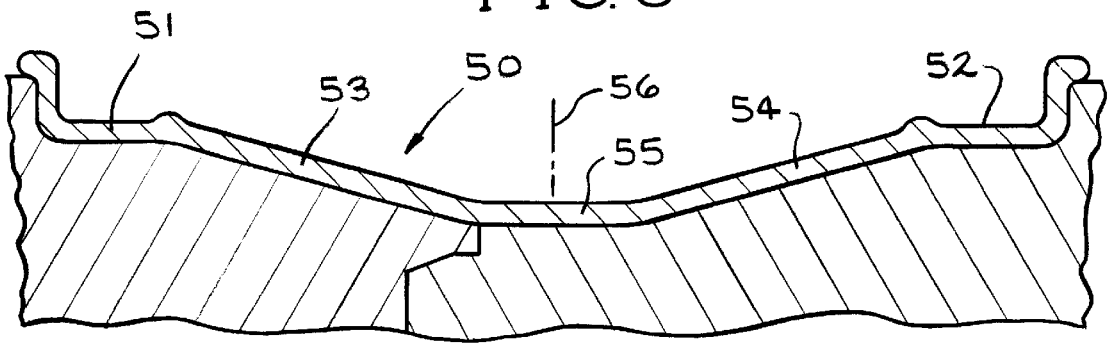
FIG. 9 is a fragmentary sectional view of another alternate embodiment of the spinning apparatus shown in FIG. 4 which is utilized to spin wheel rims having different widths.

The invention further contemplates moving the cutting plane axially to produce wheel rims having different widths, as illustrated in FIG. 9. In FIG. 9, a non-symmetrical double wheel rim 50 is spun upon a corresponding non-symmetrical mandrel. The double wheel rim 50 has a first portion 51 which is to the left in the figure and a second portion 52 which is to the right in the figure. The first portion 51 includes a first leg portion 53 while the second portion 52 includes a second leg portion 54. As can be seen, the first leg 53 is wider than the second leg 54. The double wheel rim 50 also includes a deep well portion 55 which is formed between the first and second leg portions 53 and 54. Accordingly, when the double wheel rim 50 is spilt along a cutting plane 56 which passes through the center of the deep well portion 55, two partial wheel rims are formed having different widths.

Figure 10:
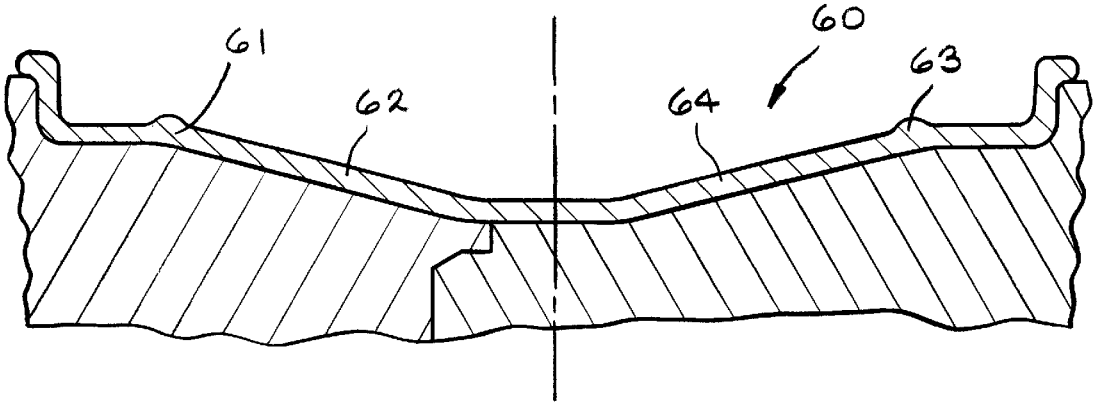
FIG. 10 is a fragmentary sectional view of an alternate embodiment of the spinning apparatus shown in FIG. 9.

FIG. 10 illustrates an alternate embodiment of the double wheel rim 50 shown in FIG. 9. In FIG. 10, a double wheel rim 60 is spun upon a corresponding non-symmetrical mandrel, as was described above. The shaped double wheel rim 60 includes a first portion 61 which is to the left in FIG. 10 and which has a straight leg portion 62. The double wheel rim 60 also includes a second portion 63 which is to the right in FIG. 10 and which has a bell shaped leg portion 64. Upon splitting the double wheel rim 60, two partial wheel rims having different shapes and different widths are formed.

Figure 11:
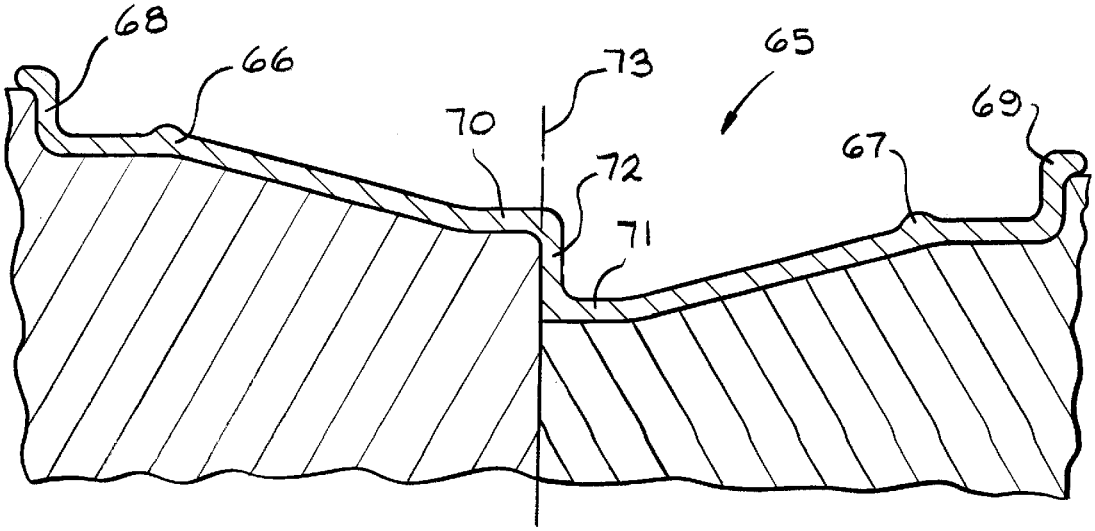
FIG. 11 is a fragmentary sectional view of another alternate embodiment of the spinning apparatus shown in FIG. 9 which is utilized to spin wheel rims having different diameters.
Figure 12:
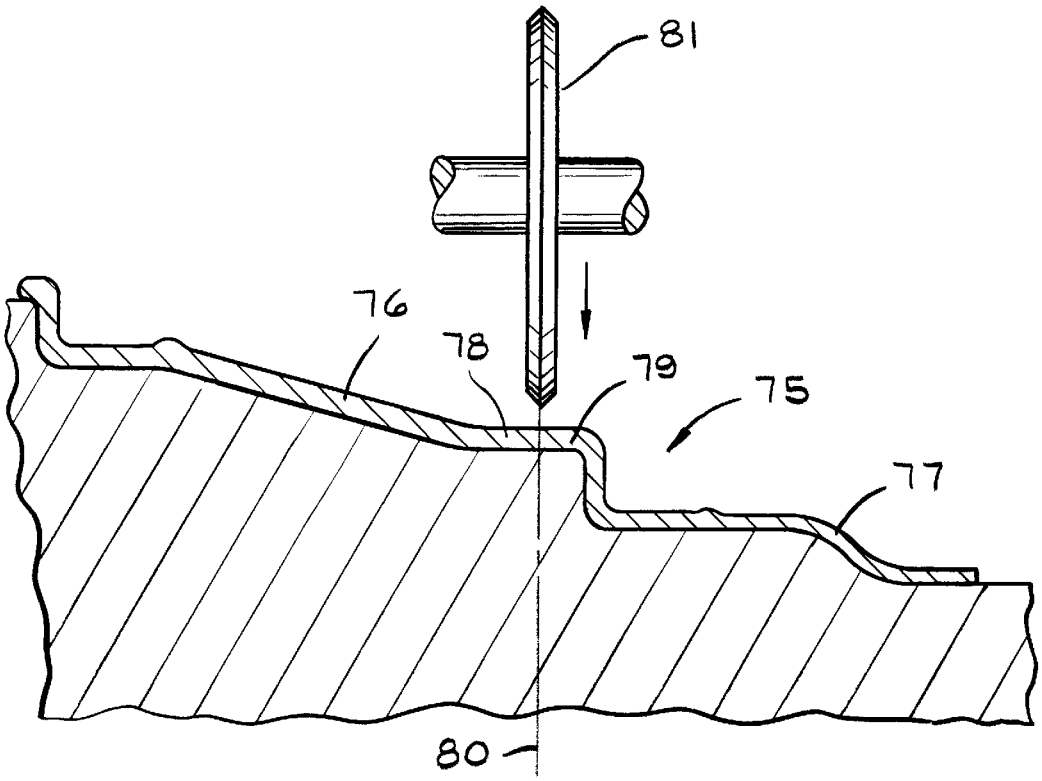
FIG. 12 is a fragmentary sectional view of an alternate embodiment of the spinning apparatus shown in FIG. 11.
Figure 13:
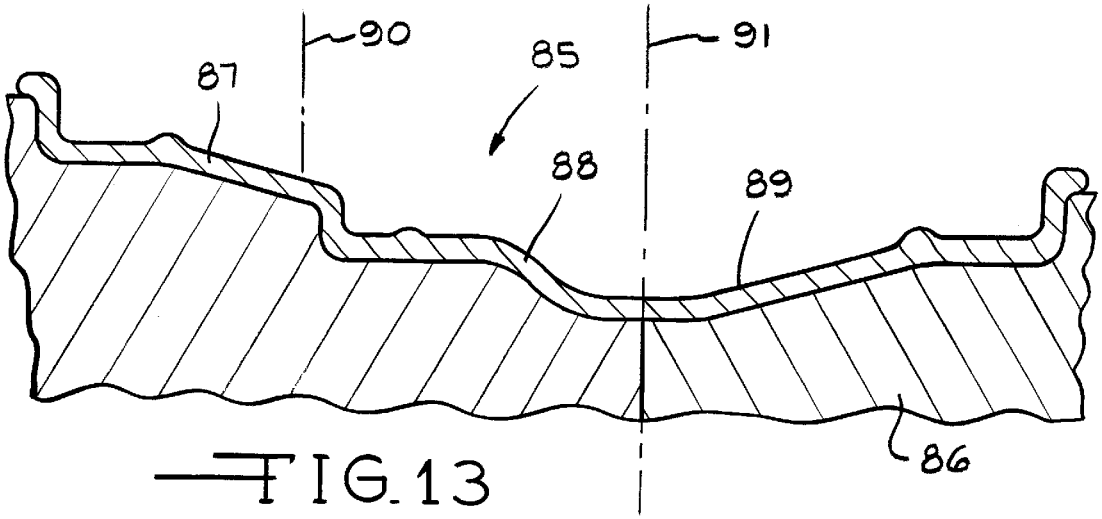
FIG. 13 is a fragmentary sectional view of an alternate embodiment of the spinning apparatus shown in FIG. 4 which is utilized to spin three partial wheel rims.

The invention also contemplates forming wheel rims having different diameters, as illustrated in FIGS. 11 through 13. In FIG. 11, a shaped double wheel rim 65 is spun upon a corresponding shaped mandrel. The double wheel rim 65 has a first portion 66 which is to the left in the figure and a second portion 67 which is to the right in the figure. The ends of the double wheel rim 65 are formed with inboard tire retaining flanges, 68 and 69, for first and second portions, 66 and 67, respectively. The center portion of the double wheel rim 65 is formed as a first deep well portion 70 for the first portion 66 and as a second deep well portion 71 for the second portion 67. The first deepwell portion 70 is joined to the second deep well portions 71 by an annular ring 71. As shown in FIG. 11, the first deep well portion 70 has a greater diameter than the second deep well portion 71.

The double wheel rim 65 is split along a cutting plane 73 which passes through the annular ring 72 to form two partial wheel rims (not shown). The remainder of the annular ring 72 is then trimmed from the inboard end of each of the wheel rims. Alternately, the double wheel rim 65 can be split adjacent to the annular ring 72 (not shown) which requires trimming only one of the resulting partial wheel rims.

An alternate process for forming a pair of partial wheel rims having different diameters is shown in FIG. 12. In FIG. 12, a double wheel rim 75 is spun upon a correspondingly shaped mandrel. The shaped double wheel rim 75 includes a first portion 76 which is to the left in the figure and a second portion 77 which is to the right in the figure. The first portion 76 includes a deep well portion 78 which is adjacent to an outboard tire retaining flange portion 79 formed upon the second portion of the double wheel rim 75. The outboard end of the flange portion 79 is indicated by a dashed line in FIG. 12. A cutting plane 80 extends through the double wheel rim 75 between the deep well portion 78 and the flange portion 79. A cutting roller 81 splits the double wheel rim 75 along the cutting plane 80 to form two partial wheel rims. As can be seen in FIG. 12, the resulting wheel rims will have different diameters.

The invention further contemplates forming a plurality of wheel rims which have different shapes upon a single spin forming machine. As shown in FIG. 13, a triple wheel rim 85 can be spun upon a mandrel 86 which is shaped to form three partial wheel rims. The shaped triple wheel rim 85 has a first portion 87 which is to the left in the figure, a second portion 88 which is in the center of the triple wheel rim 85 and a third portion 89 which is to the right in the figure. The triple wheel rim 85 is split along two cutting planes 90 and 91 to form three partial wheel rims. The first portion 87 forms a wheel rim having a straight leg portion while the second portion 88 forms a wheel rim having a bell shaped leg portion and a smaller diameter than the wheel rim formed from the first portion 87. The third portion 89 forms a second wheel rim having straight leg portion and a smaller diameter than the wheel rim formed from the first portion 87. It also will be appreciated that the wheel rims illustrated in FIGS. 11 through 13 can be formed having different widths, as shown in FIGS. 9 and 10.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, while the preferred embodiment has been illustrated and described for spinning wheel rims, it will be appreciated that the invention also can be practiced for rolling wheel rims. Also, specific details of a wheel rim shown in one of the figures can be included in wheel rims shown in the other figures.

What is claimed is:

1. A mandrel for spin forming partial vehicle wheel rims, the mandrel comprising:

a first portion having a first shape, said first shape including a cylindrical portion adapted to form a cylindrical end portion of a first partial wheel rim, said first portion adapted for spin forming a first portion of a metal hoop into a first partial wheel rim having a shape corresponding to said first shape of said first mandrel portion, said first partial wheel rim including a cylindrical end portion which is adapted for attachment to a first full face wheel disc, said full face wheel disc including an outboard tire bead retaining flange; and a second portion having a second shape, said second shape including a cylindrical portion adapted to form a cylindrical end portion of a second partial wheel rim, said second portion adapted for spin forming a second portion of said metal hoop into a second partial wheel rim having a shape corresponding to said second shape of said second mandrel portion, said second partial wheel rim including a cylindrical end portion which is adapted for attachment to a second full face wheel disc, said full face wheel disc including an outboard tire bead retaining flange, whereby two two-piece wheels can be formed from the two partial wheel rims formed upon the mandrel.

2. A mandrel according to claim 1 wherein said second mandrel portion is symmetrical to said first mandrel portion, whereby said second vehicle wheel rim formed on said second mandrel portion has the same shape as said first vehicle wheel rim formed upon said first mandrel portion.

3. A mandrel according to claim 1 wherein said second mandrel portion is asymmetrical to said first mandrel portion, whereby said second vehicle wheel rim formed on said second mandrel portion has a different shape from said first vehicle wheel rim formed upon said first mandrel portion.

4. A mandrel according to claim 3 wherein said first and second portions of said mandrel are shaped to form a double wheel rim having a central deep well portion and an outboard tire retaining flange formed on each end thereof.

5. A mandrel according to claim 4 wherein said deep well portion is axially offset such that said first wheel rim formed thereon has a first width and said second wheel rim formed thereon has a second width, said first width being different from said second width.

6. A mandrel according to claim 3 wherein said first portion has a first end adapted to form an outboard end of a first partial wheel rim and a second end adapted to form at least a portion of a deepwell of said first partial wheel rim, said deepwell portion of said first partial wheel rim having a first diameter and further wherein said second portion has a first end adapted to form at least a portion of a deepwell of a second partial wheel rim and a second end adapted to form an outboard end of said second partial wheel rim, said deepwell portion of said second partial wheel rim having a second diameter which is different from said first diameter.

7. A mandrel according to claim 6 wherein said second end of said first mandrel portion is adjacent to said first end of said second mandrel portion.

8. A mandrel according to claim 6 wherein said second end of said first mandrel portion is adjacent to said second end of said second mandrel portion.

9. An apparatus for forming partial vehicle wheel rims comprising:

a spin forming machine;

a mandrel mounted upon said spin forming machine, said mandrel including a first portion having a first shape, said first shape including a cylindrical portion adapted to form a cylindrical end portion of a first partial wheel rim, and a second portion having a second shape, said second shape also including a cylindrical portion adapted to form a cylindrical end portion of a second partial wheel rim;

at least one forming roller adapted to spin form a hoop of metal over said mandrel to form a double wheel rim, said double wheel rim including a first portion shaped to conform to said first shape of said first portion of said mandrel, said first portion including a first cylindrical end portion, said double wheel rim also including a second portion shaped to conform to said second shape of said second portion of said mandrel, said second portion including a second cylindrical end portion; and a cutting roller adapted to split said double wheel rim into first and second partial wheel rims, said first partial wheel rim corresponding to said first portion of said double wheel rim and including said first cylindrical end portion, said first cylindrical end portion being adapted for attachment to a first full face wheel disc, said first full face wheel disc including an outboard tire bead retaining flange, said second partial wheel rim corresponding to said second portion of said double wheel rim and including said second cylindrical end portion, said second cylindrical end portion being adapted for attachment to a second full face wheel disc, said full face wheel disc including an outboard tire bead retaining flange, whereby two two-piece wheels can be formed from the two partial wheel rims formed upon the sin forming machine.

10. An apparatus according to claim 9 wherein said second portion of said mandrel is symmetrical to said first portion of said mandrel, whereby said second vehicle wheel rim formed on said second mandrel portion has the same shape as said first vehicle wheel rim formed upon said first mandrel portion.

11. An apparatus according to claim 9 wherein said second portion of said mandrel is asymmetrical to said first portion of said mandrel, whereby said second vehicle wheel rim formed on said second mandrel portion has a different shape from said first vehicle wheel rim formed upon said first mandrel portion.

12. An apparatus according to claim 11 wherein said first and second portions of said mandrel are shaped to form a double wheel rim having a central deep well portion and an outboard tire retaining flange formed on each end thereof, and further wherein said cutting roller is adapted to split said double wheel rim in said deep well portion to form a first partial wheel rim and a second partial wheel rim.

13. An apparatus according to claim 11 wherein said cutting roller is adapted to split said double wheel rim along a cutting plane which is perpendicular to the axis of said double wheel rim and offset from the center thereof to form a first partial wheel rim having a first width and a second wheel rim having a second width, said first width being different from said second width.

14. An apparatus according to claim 11 wherein said first portion of said mandrel has a first end adapted to form an inboard end of a first partial wheel rim and a second end adapted to form at least a portion of a deepwell of said first partial wheel rim, said deepwell portion of said first partial wheel rim having a first diameter and further wherein said second portion of said mandrel has a first end adapted to form at least a portion of a deepwell of a second partial wheel rim and a second end adapted to form an inboard end of said second partial wheel rim, said deepwell portion of said second partial wheel rim having a second diameter which is different from said first diameter.

15. An apparatus according to claim 14 wherein said second end of said first portion of said mandrel is adjacent to said first end of said second portion of said mandrel and said cutting roller is adapted to spit a double rim formed upon said mandrel along a cutting plane which is perpendicular to the axis of said mandrel and passes through said double wheel rim to form said first and second partial wheel rims, said cutting plane passing between said first deepwell portion of said first partial wheel rim and said second deepwell portion of said second partial wheel rim.

16. An apparatus according to claim 14 wherein said second end of said first portion of said mandrel is adjacent to said second end of said second portion of said mandrel and said cutting roller is adapted to spit a double rim formed upon said mandrel along a cutting plane which is perpendicular to the axis of said mandrel and passes through said double wheel rim to form said first and second partial wheel rims, said cutting plane passing between said first deepwell portion of said first partial wheel rim and said outboard end of said second partial wheel rim.

* * * * *